United States Patent [19]

Raksanyi

[11] 4,051,960

[45] Oct. 4, 1977

[54] LOCKING END ACTUATING MECHANISM FOR RAILWAY HOPPER CAR DOORS

[75] Inventor: William Raksanyi, Hammond, Ind.

[73] Assignee: Pullman Incorporated, Chicago, Ill.

[21] Appl. No.: 735,239

[22] Filed: Oct. 26, 1976

[51] Int. Cl.[2] ..... B65G 67/24

[52] U.S. Cl. ..... 214/63; 292/216; 105/308 E; 105/241 C; 298/31

[58] Field of Search ..... 214/63, 58; 298/31-35 R; 105/241 C, 251, 308 E, 308 R, 250, 254, 245; 292/DIG. 1, 216, 78, 221

[56] References Cited

U.S. PATENT DOCUMENTS

| | | | |
|---|---|---|---|
| 2,156,874 | 5/1939 | Schonitzer | 292/216 |
| 2,430,517 | 11/1947 | Lunde | 105/308 E |
| 2,546,897 | 3/1951 | Lunde | 105/308 E |
| 3,994,238 | 11/1976 | Adler | 214/63 |

*Primary Examiner*—Robert J. Spar
*Assistant Examiner*—Lawrence E. Williams
*Attorney, Agent, or Firm*—Richard J. Myers

[57] ABSTRACT

A railway hopper car includes side discharge openings and hinged door assemblies which are maintained in a locked position by an improved latching mechanism. The latching mechanism is pivotally connected to car structure and includes a positive lock arrangement adapted to be actuated by a linkage arrangement tripped by a cam assembly supported on the ground adjacent to the path of movement of the hopper car.

10 Claims, 2 Drawing Figures

LOCKING END ACTUATING MECHANISM FOR RAILWAY HOPPER CAR DOORS

BACKGROUND OF THE INVENTION

1. Field of the Invention

This invention relates to railway hopper cars of the side-dump type including an improved locking and latching mechanism.

2. Description of the Prior Art

The prior art disclosing locking mechanism for side opening door arrangements for hopper cars are disclosed in U.S. Pat. Nos. 2,430,517, Nov. 11, 1947; 2,546,897, Mar. 27, 1951; 2,891,816, June 23, 1959; 3,868,913, Mar. 4, 1975; and 3,931,768, Jan. 13, 1976. The present invention is an improvement over the above patented designs in that it provides for a more improved reliable and efficient locking mechanism for door arrangements which are opened and closed by ground supported camming means.

SUMMARY OF THE INVENTION

A hopper car is provided with side discharge door arrangements which are hingedly connected to the sides of the car. Each of the doors is swingable outwardly to provide for the discharge of materials and is locked by the improved locking mechanism of the present invention. The locking and latching mechanism includes a latch member which is provided with an open end keeper engaging slot adapted to engage a keeper mounted on a door structure. The latching member is maintained in a substantially vertical position effectively retaining the keeper in the open end slot by means of a toggle linkage mechanism which is also maintained in a closed position by an improved locking and unlocking lever. The unlocking lever in the closed position of the door includes a plate member which overlies the toggle linkage and prevents any unlocking movement thereof. The car also has supported thereon, underneath the underframe, a longitudinally extending trip lever having rotatable trip members connected thereto. The trip members each include camming means adapted to be moved into engagement with a camming extension of the toggle linkage arrangement which, in turn, pivots the unlocking lever to an unlocked position. During this movement of the unlocking lever the toggle linkage is pivoted which, in turn, pivots the latch member and the open end slot to a release position whereupon the hinged door can move outwardly providing for the discharge of material from the hopper car. The trip members and longitudinal operating lever or bar are actuated by means of a lever and roller arrangement which is, in turn, actuated by a cam supported along the railway track in the path of movement of the hopper car. A second camming arrangement also is provided to be engaged by roller means on the door adapted to swing the doors again to the closed position whereupon the latching mechanism is engaged and again is moved to the locked position.

DESCRIPTION OF THE PREFERRED EMBODIMENT

Figure 1:
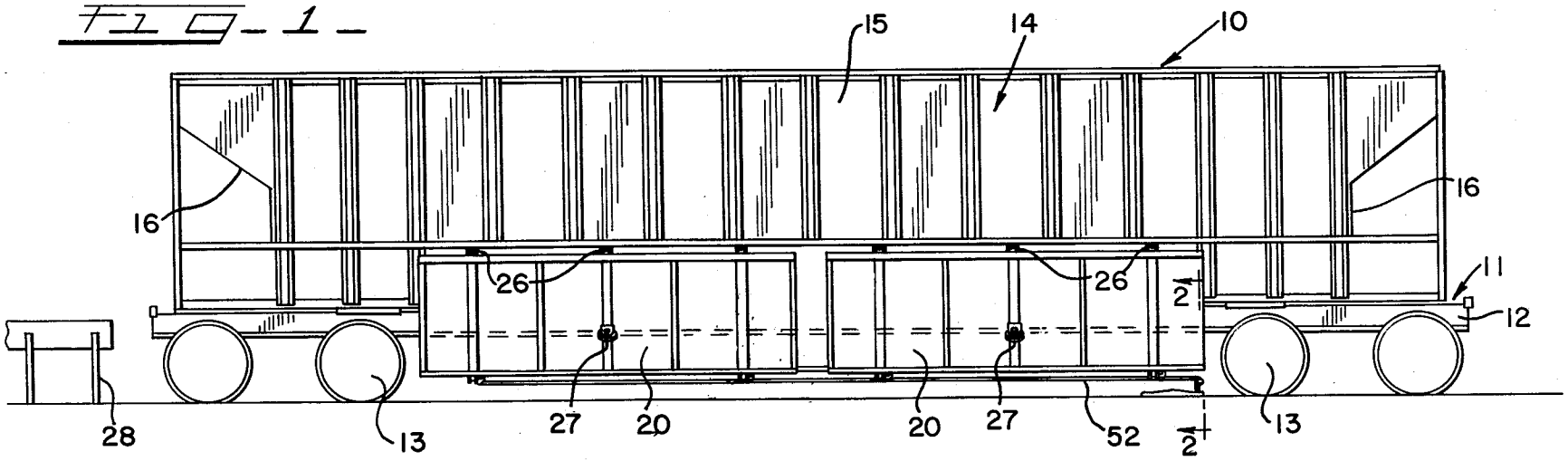
FIG. 1 is a side elevational view of a hopper car including pairs of discharge doors positioned on opposite sides of the car.

Referring now particularly to FIG. 1 an open top railway hopper car 10 comprises an underframe 11 including a center sill 12. The center sill 12 is suitably supported on wheel trucks 13. A car body is generally designated at 14 and includes laterally spaced vertical sides 15 and end walls 16 at opposite ends thereof.

Figure 2:
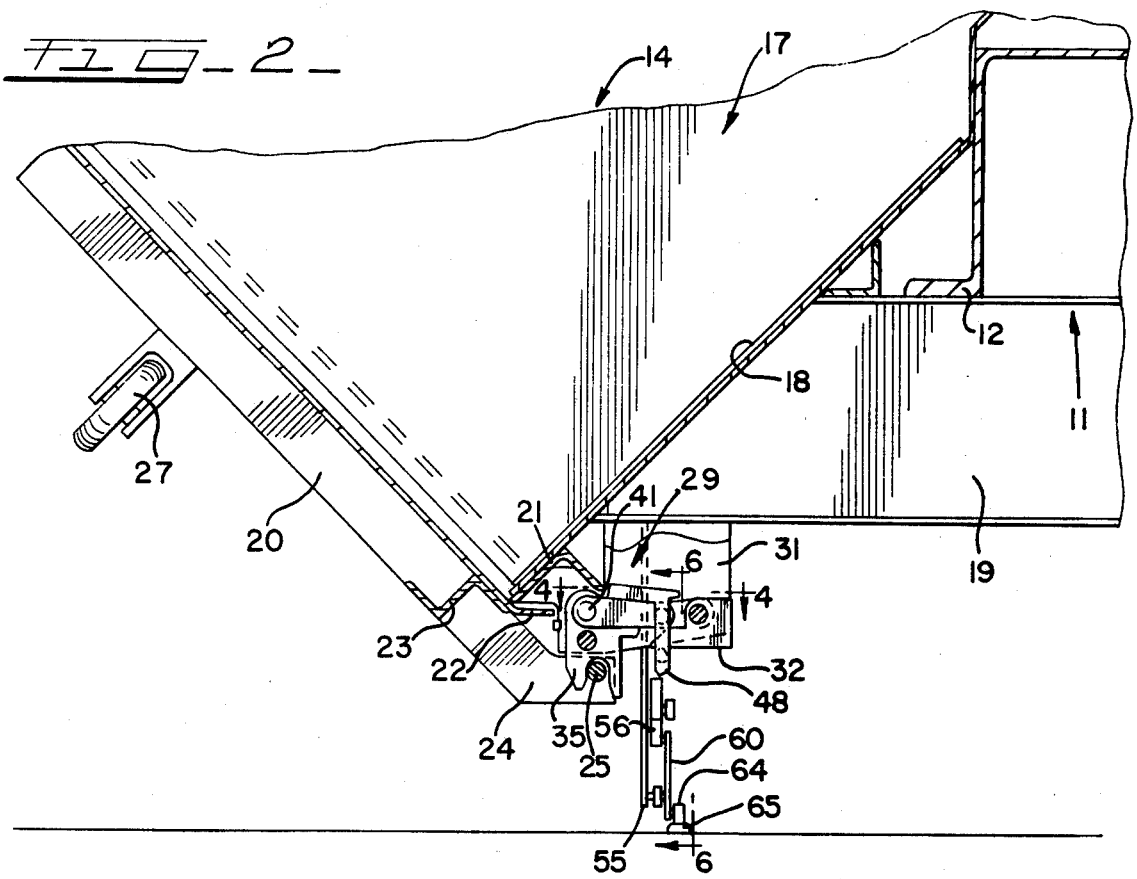
FIG. 2 is a cross-sectional view on one side of the car taken substantially along the line 2—2 of FIG. 1.
Figure 3:
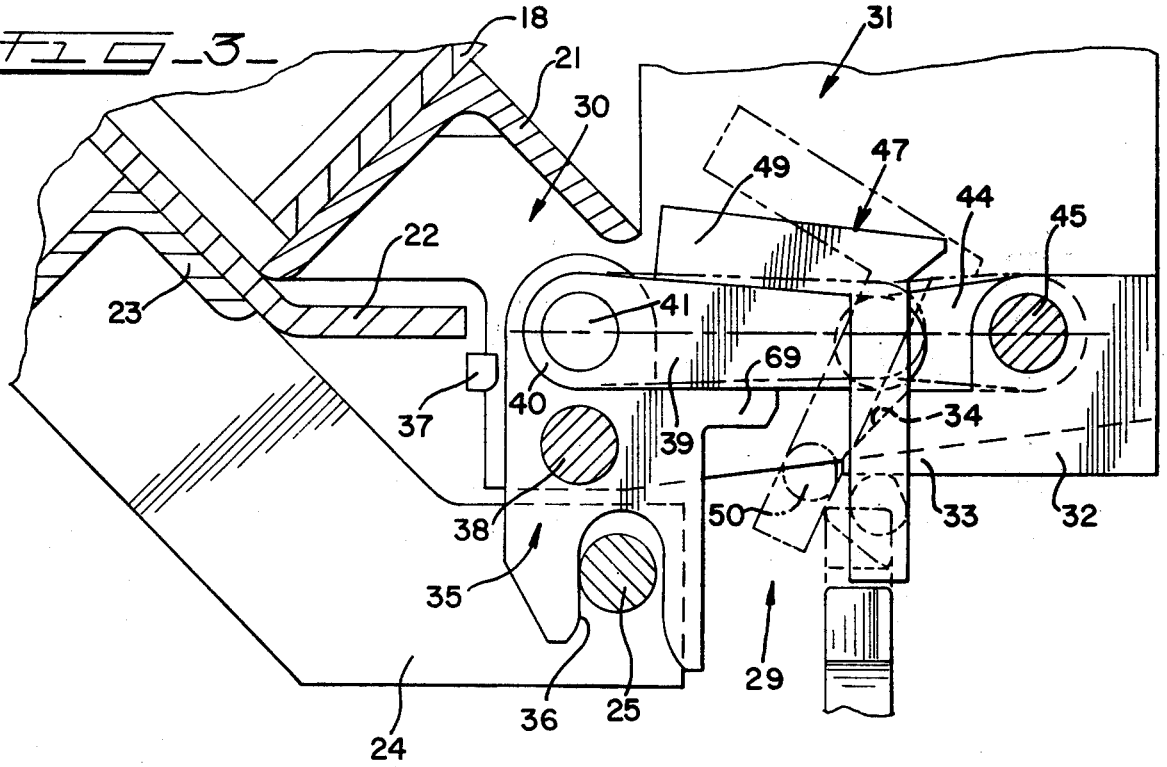
FIG. 3 is an enlarged side elevational view of a portion of a latching mechanism also disclosed in FIG. 2.

The car 10 comprises one or more of hoppers generally designated at 17 which as shown in FIG. 2 are provided with suitable bottom slope sheets 18 to discharge materials contained within the hopper laterally sideways outwardly of the hopper car. The slope sheets 18 are adapted to be supported by means of transverse supports 19 suitably connected to the center sill 12. Each of the hoppers is closed by means of a swinging door 20. As best shown in FIGS. 2 and 3, the lower end of the slope sheet 18 is suitably supported and has connected thereto a longitudinally extending angle member 21. The lower end of the door 22 also is provided with an inwardly projecting flange 22 adapted to engage the angle 21 in sealing relation during the closed position of the door 20. The lower end of the door 20 also includes a Z-shaped longitudinally extending stringer 23 having connected thereto an inwardly extending bracket 24. The bracket 24 also supports a longitudinally extending keeper pin 25. As best shown in FIG. 1, the upper ends of the doors 22 may be hingedly secured to the sides 15 of the car by means of hinge members 26. Each of the doors also includes roller members 27 adapted to engage track side ground supported cams 28 for swinging the doors to a closed position when the car moves alongside said cams.

Figure 4:
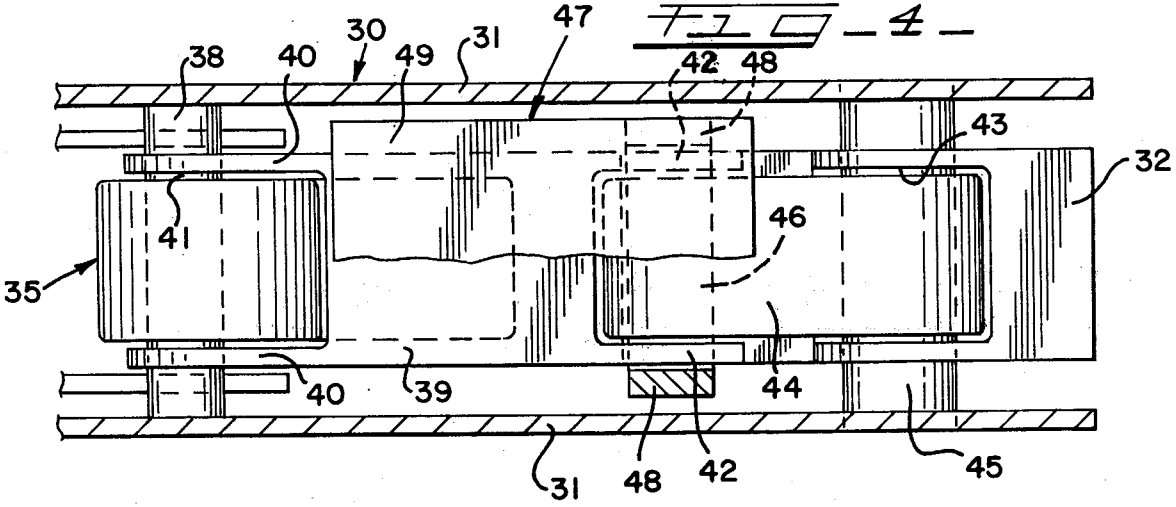
FIG. 4 is a cross-sectional view taken substantially along the line 4—4 of FIG. 2.
Figure 5:
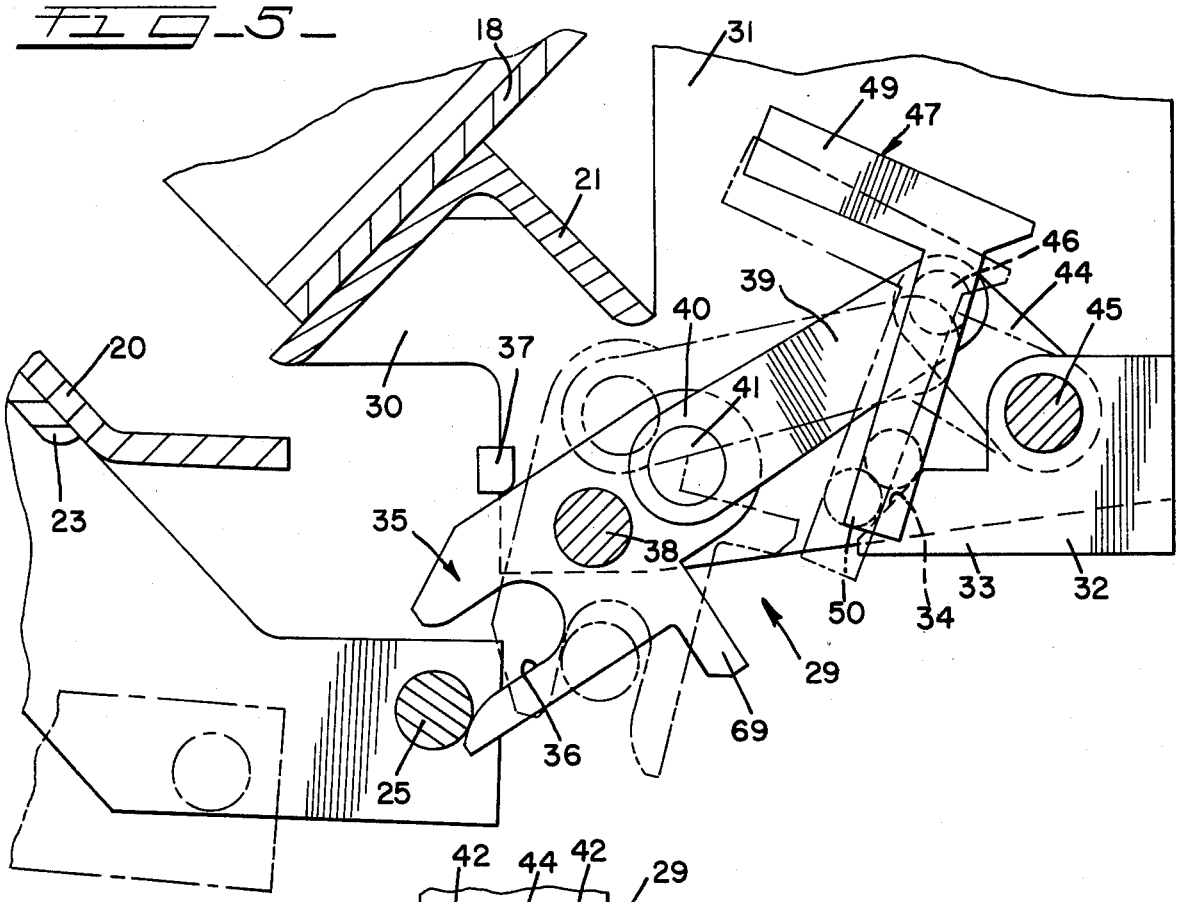
FIG. 5 is a view similar to FIG. 3 showing the release operation of a latching mechanism in connection with a side discharge door.

Referring now particularly to FIGS. 2–6 a door latching mechanism is generally designated at 29 and is suitably supported on a bracket 30 connected to the angle member 21 and which also includes vertical support plate members 31 longitudinally spaced and rigidly supported by the transverse support 19. A guide and stop member or block 32 is rigidly secured between and to the lower ends of the vertical plate members 31. The stop block 32 includes a nose 33 having a tapering guide surface 34 as best shown in FIG. 5. A latch member is generally designated at 35 and includes at its lower end an open end slot or notch 36 which is adapted in its closed position to engage the keeper bar 25 of the door 20. The bracket 30 also includes a guide member 37 which limits the pivotal movement, in an upward direction, of the lower portion of the latch member 35 as best shown in FIG. 5. The latch member 35 is suitably supported on the bracket 30 by means of a pivot member 38. A toggle link 39 as best shown in FIGS. 4 and 5 includes forward arm portions 40 connected to a pivot pin 41 which is connected to the upper portion of the latch member 35. The toggle link 39 also includes rearward spaced arms 42 as best shown in FIG. 4. The guide or stop block 32 as best shown in FIG. 4 also includes a cut out 43. A second toggle link 44 is pivotally connected to a pivot pin 45 which, in turn, is supported on the block 32 and the vertical spaced side plate portions 31. A pivot pin 46 connects the spaced rear arms 42 to the second toggle link 44.

Figure 7:
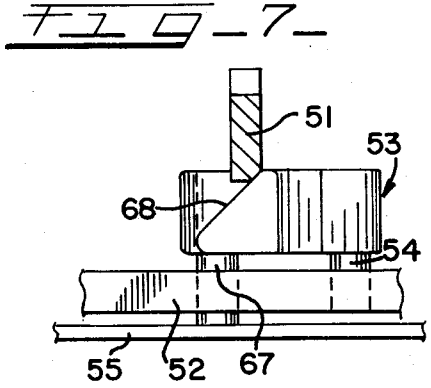
FIG. 7 is a cross-sectional view taken substantially along the line 7—7 of FIG. 6.
Figure 6:
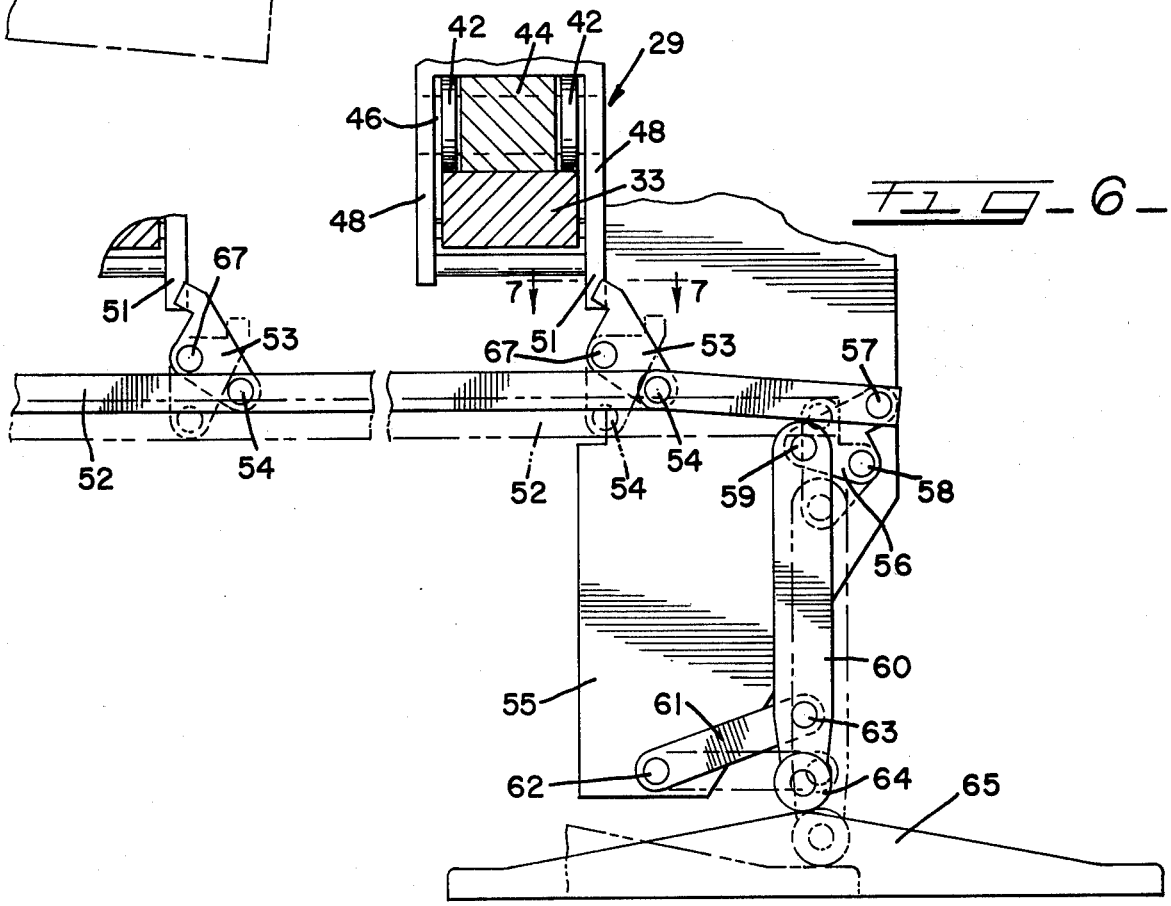
FIG. 6 is a cross-sectional view taken substantially along the line 6—6 of FIG. 2.

A pivoted locking and unlocking lever 47 includes longitudinally spaced downwardly extending arms 48 and has connected thereto a substantially horizontal upper arm 49 in the shape of a plate as best shown in FIGS. 3 and 4. A cylindrical guide member 50 is rigidly secured to the longitudinally spaced vertical arms 48 and is adapted to engage a guide surface 34 as the lever 47 is moved to an unlocked position. As best shown in FIGS. 6 and 7 one of the arms 48 is also provided with a lower extension 51 which is adapted to be engaged by a trip lever 53.

The latching or locking mechanism further is operated by means of a longitudinally extending operating bar 52 which is supported underneath the underframe of the railway car. For each of the doors a trip element 53 is provided which is suitably and pivotally connected by means of pivot members 54 to the longitudinal bar 52. Each of the trip levers 53 is also suitably supported by pivot members 67 to the underframe structure of the car.

As best shown in FIGS. 2 and 6 a longitudinally extending vertical plate 55 projects downwardly from the underframe structure of the car. The plate 55 supports a bell crank lever 56 which, in turn, is pivotally connected at one point to the longitudinal operating bar 52 as indicated at 57. A pivot connection 58 connects the bell crank lever 56 to the vertical plate 55. The other end of the bell crank lever 56 is pivotally connected as indicated at 59 to a vertical actuating arm 60. A link 61 is pivotally connected to the vertical plate 55 by means of a pivot pin 62 and is also connected to the vertical arm 60 by means of a pivot pin 63. The vertical actuating arm 60 is provided at its lower end with a roller 64 which is adapted to engage and ride upon an inclined cam 65 supported on the ground adjacent to the track on which the railway car is supported.

As best shown in FIG. 7, the trip lever 53 is pivotally supported on the longitudinal operating bar 52 and also pivotally supported on the plate 55 by means of the pivot pin 67. As also best shown in FIG. 7, the trip lever 53 is provided with a tapered cam surface 68 which is adapted to engage one end of the extension 51 thereby pivoting the unlocking lever 47 to the release position shown in FIG. 5 wherein the toggle linkage is moved upwardly to the release position.

THE OPERATION

Referring particularly to FIGS. 2 and 3 the door 20 is in a locked position wherein the latch member 35 extends substantially vertically and is in locking engagement with the keeper 25 which is contained within the open end slot 36. The unlocking lever 47 has its horizontal plate or arm 49 disposed over the toggle links 39 and 44 preventing these from moving upwardly. The cylindrical guide member 50 also acts as a stop and is trapped underneath the nose 33. Thus, the door is securely locked for over-the-road operation. As the car approaches the dumping pit, the actuating arm 60 shown in FIG. 6 moves upwardly in response to the roller 64 traveling up on the inclined cam 65. By virtue of the bell crank lever 56, and its pivotal connections, the operating bar 52 is moved to the right which causes the trip lever 53 to move in a counterclockwise direction contacting the extension 51 which thereupon provides for the pivotal movement of the toggle links 39 and 44 to the jackknife position since the horizontal locking arm 49 is moved to the open position. Upward jackknife movement of the toggle linkage carries the arm upwardly in response to the movement of the tapered cam 68 of the lever 53. Simultaneously the cylindrical guide members 50 move up the inclined surface 34 and nose of the stop member 32 maintaining the arm 49 in the open non-blocking position. Thus the toggle linkage assumes the position shown in FIG. 5. The latch member 35 now is released from the keeper pin 25 and the door 20 is free to move outwardly to the open position so that the load can be dumped. After the car passes beyond the ground cam 65 the trip lever 53 again assumes the dotted line disengaging position, of FIG. 6, and the unlocking lever 47 remains in the open position. As the car moves along the rollers 27 the doors are now engaged by the closing cam 28 which throws the door 20 inwardly until the keeper 25 again engages the slot 36 whereupon the latch member 35 again assumes the vertical position. A stop 69 on the latch member 35 engages the underneath surface of the toggle link 39 and the unlocking lever 47 again assumes the locked position shown in FIG. 3. The latch mechanism is now again securely locked with the doors in the closed position.

What is claimed is:

1. A railway hopper car having a door hinged at its upper end to said car for outward swinging movement of its lower end to an open position and a keeper on said lower end if said door, the improvement of a latch mechanism on said car adjacent said lower end comprising:

a bracket on said car, a latch member having a keeper engaging portion in the closed position of said door extending vertically and blocking outward movement of said door, means pivotally mounting said latch member above said keeper for clockwise and counterclockwise movement, actuating linkage for said latch member including a first toggle link pivotally connected to said latch member, a second toggle link including means pivotally connecting the same to said first toggle link, means pivotally connecting said second toggle link to said bracket, an unlocking lever including an upright arm, said lever being pivotally connected to the pivotal connecting means of said toggle links, said lever including a second arm in the loading position blocking pivotal movement of said toggle links, and operating means exerting an upward thrust on said upright arm, thereby pivoting said second arm to an out-of-the-way position whereby said toggle links are pivoted, thereby swinging said latch member in a clockwise direction whereby said keeper is released from said keeper engaging portion to permit movement of said door to said open position.

2. The invention in accordance with claim 1, and said first arm including cam means, and a cam element on said bracket engaged by said cam means for guiding said second arm to said out-of-the-way position.

3. The invention in accordance with claim 1, and said bracket including a stop projection and means on said first arm interengaging said stop projection to maintain said second arm in said locking position.

4. The invention in accordance with claim 3, and said means on said first arm including a cam means, and a cam surface on said bracket engaged by said cam means during pivotal movement of said lever.

5. The invention in accordance with claim 4, and said keeper engaging portion comprising an open end slot defined by opposed guide surfaces.

6. The invention in accordance with claim 1, and said second arm comprising a flat plate in the blocking position overlying said toggle links.

7. The invention in accordance with claim 1, including operating means for exerting an operating force on said lever including a longitudinal actuating bar movably mounted on said car, and a tripping element movably mounted on said bar for engaging said lever, thereby actuating said latch mechanism.

8. The invention in accordance with claim 7, including a trip lever pivotally mounted on said car and pivotally connected to said longitudinal bar.

9. The invention in accordance with claim 8, including ground supported camming means engaged by said trip lever for moving said bar during railway car movement.

10. The invention in accordance with claim 9, including a bell crank lever pivotally mounted on said car and pivotally connected to said trip lever and to said bar for translating pivotal movement of said trip lever into longitudinal movement of said bar.

* * * * *